United States Patent [19]

Frobose

[11] Patent Number: 4,563,041

[45] Date of Patent: Jan. 7, 1986

[54] UPHOLSTERED SEAT FOR CLEAN ROOM USE

[75] Inventor: James W. Frobose, Haskins, Ohio

[73] Assignee: The Jasper Corporation, Easton, Md.

[21] Appl. No.: 551,914

[22] Filed: Nov. 15, 1983

[51] Int. Cl.[4] ..... A47C 7/18

[52] U.S. Cl. ..... 297/452; 5/468; 297/DIG. 1

[58] Field of Search ..... 5/467, 468, 481; 297/DIG. 1, DIG. 2, 452, 455, 180, DIG. 3

[56] References Cited

U.S. PATENT DOCUMENTS

| | | | |
|---|---|---|---|
| 859,828 | 7/1907 | McCloud | 5/468 |
| 1,156,939 | 10/1915 | Smith | 297/DIG. 1 |
| 2,713,892 | 7/1955 | Knapp | 297/DIG. 1 |
| 4,445,241 | 5/1984 | Ender et al. | 5/468 |

FOREIGN PATENT DOCUMENTS

| | | | |
|---|---|---|---|
| 1144450 | 2/1963 | Fed. Rep. of Germany | 5/468 |

*Primary Examiner*—William E. Lyddane
*Assistant Examiner*—Mark W. Binder
*Attorney, Agent, or Firm*—Brady, O'Boyle & Gates

[57] ABSTRACT

To assist in maintaining the high degree of cleanliness required by Federal standards in industrial clean rooms, an upholstered seat is provided having a sealed filter element through which air must flow when entering or exiting the seat structure. A hard base member having a cushion mounted thereon is enclosed within an air-impermeable cover. The filter element in the form of a hydrophilic or hydrophobic sheet is placed between the hard base member and cover. The hard base member and cover contain air breathing apertures on opposite sides of the filter element. The upholstered seat exceeds Federal standards in its ability to avoid contaminating clean rooms.

4 Claims, 4 Drawing Figures

UPHOLSTERED SEAT FOR CLEAN ROOM USE

BACKGROUND OF THE INVENTION

The manufacture of microchips and some other industrial products has created a necessity for an extreme degree of cleanliness in manufacturing facilities, commonly called clean rooms. As a result of these cleanliness requirements, Federal standards have been promulgated and must be strictly complied with by the industries involved. Current Federal Standard No. 209B pertaining to classes of room cleanliness establishes three classes of clean rooms, Class 100 being the strictest of these classes. Class 100 specifies that only 100 particles of 0.5 micron size or larger are allowed per cubic foot of air in the clean room. The standard does not pertain to merely an average foot of air but to any cubic foot, at any time. Suggested air velocities are also listed for each class under Federal Standard No. 209B.

A main object of the present invention is to fully comply with and substantially exceed the requirements of Class 100 under Federal Standard No. 209B, in connection with upholstered furniture for clean room use, such as chairs, stools and other seat structures.

Presently, no conventional upholstered furniture or wooden furniture can be tolerated in clean rooms because of the micro particles expelled by them into the environment during normal usage. Such furniture falls far short of even the most liberal class under Federal Standard No. 209B, namely Class 100,000. Metal furniture, such as furniture made entirely of stainless steel, can meet the Federal standards but such furniture becomes so uncomfortable during long usage as to be intolerable, and does not represent a complete solution to the problem.

A further object of the present invention is to provide comfortable upholstered furniture, including various types of seats for clean room usage which fully comply with and exceed the cleanliness requirements under Federal standards or self-imposed industrial standards.

Another object of the invention is to provide seat cushions or seat backs in upholstered forms which include sealed air-impermeable coverings for the yielding cushions and hard base members thereof, in conjunction with a highly efficient filter element through which all air must flow when leaving or entering the upholstered furniture structure.

The filter element embodied in the invention is either a hydrophilic or hydrophobic sheet element possessing the ability to exclude particles as small as 0.2 microns from passing through the filter elements, thus exceeding substantially the requirements of Class 100 under Federal Standard No. 209B.

The sheet filter element is interposed between the hard panel member of the seat or other body support component of upholstered furniture and the exterior air-impermeable cover. Breathing apertures are provided in the hard panel member and cover which may be in registering or non-registering staggered relationship. In either case, air leaving or entering the structure through the breathing openings must also traverse the filter element, thus preventing particle contamination of the surrounding environment.

Other features and advantages of the invention will become apparent to those skilled in the art during the course of the following detailed description.

DETAILED DESCRIPTION

Figure 1:
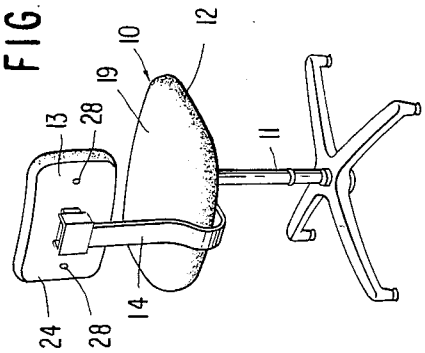
FIG. 1 is a perspective view of an upholstered chair for clean rooms according to the present invention.

Referring to the drawings in detail, wherein like numerals designate like parts, a typical upholstered technician's chair 10 for a clean room according to the invention is shown in FIG. 1. The invention is equally applicable to other types of upholstered clean room furniture, such as stools, other types of chairs or benches. The chair 10 in FIG. 1 includes a metal pedestal 11, an upholstered seat 12 attached to the pedestal, and an upholstered backrest 13 adjustably attached to a metal arm 14 rising from the seat 12. The invention herein is embodied in the seat 12 and backrest 13 and can be similarly embodied in any upholstered furniture body supporting surface.

Figure 4:
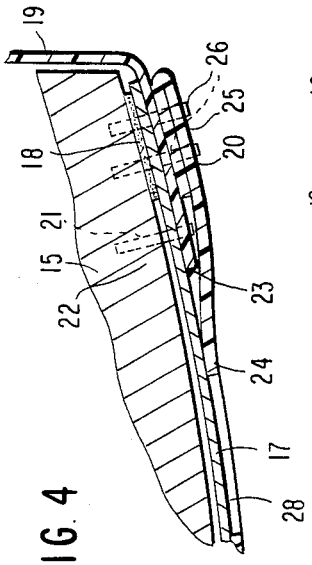
FIG. 4 is a further enlarged fragmentary vertical section through the upholstered seat portion on the same plane as FIG. 3.
Figure 2:
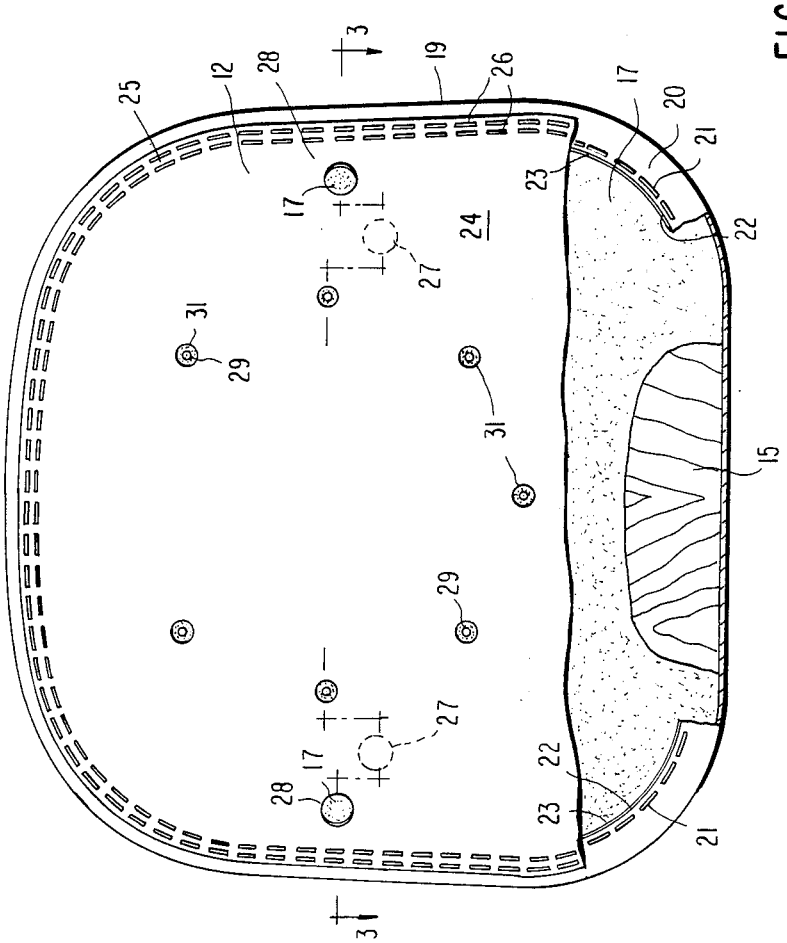
FIG. 2 is an enlarged bottom plan view, parts broken away, of the upholstered seat portion of the chair in FIG. 1.
Figure 3:
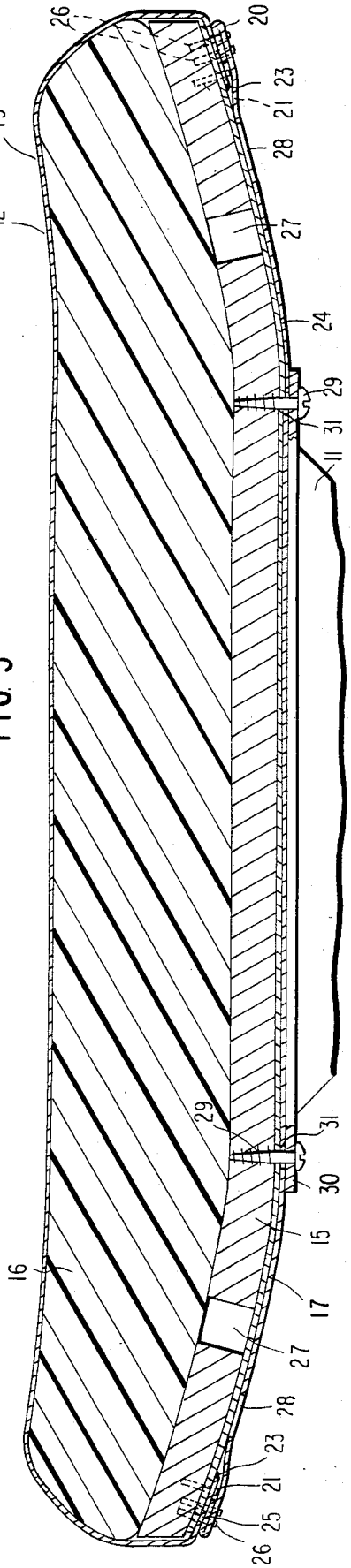
FIG. 3 is a further enlarged vertical section taken on line 3—3 of FIG. 2.

FIGS. 2, 3 and 4 showing the essence of the invention depict in detail the structure of the chair seat 12 in FIG. 1. Substantially the identical details apply to the backrest 13 or to any body supporting portion of other upholstered furniture for clean rooms according to the invention.

The seat 12 comprises a substantially rigid preferably contoured base panel member 15 of wood or the like, on the upper face of which is mounted a resilient cushion 16 of suitable material, such as foam rubber or foam plastics material.

A filter elements in the form of a sheet 17 of hydrophilic or hydrophobic material is applied over the lower face of rigid panel member 15 and near its margin is attached and sealed to the member 15 by a continuous layer 18 of adhesive sealant, FIG. 4. The adhesive sealant extends around the entire margin of the filter element 17 and precludes the passage of air outwardly or inwardly between the element 17 and panel member 15.

The sheet filter element 17 may be formed of hydrophilic material manufactured by Gelman Sciences, Inc., Ann Arbor, Mich., under the trademark VERSAPOR, Manufacturer's No. V-200, or their hydrophobic material, Manufacturer's No. V-200H. Similar material manufactured by other companies may also be used. This filtering medium can preclude the passage therethrough of particles as small as 0.2 microns. The particular material is employed to substantially exceed the requirements under Class 100 of Federal Standard No. 209B.

An air-impermeable preferably vinyl top cover section 19 is stretched over the cushion 16 and base panel member 15, with a lower marginal edge portion 20 thereof attached permanently to the bottom face of the member 15 by a line of staples 21 or equivalent means. The edge 22 of top cover section 19 is sealed to the sheet filter element 17 by a continuous bead 23, FIG. 4, of adhesive air-impermeable sealant, so that air cannot pass outwardly or inwardly between the element 17 and top cover section 19.

A bottom cover section 24 of sheet vinyl is applied over the bottom face of rigid panel member 15, and a double thickness marginal fold 25 of this bottom cover section is permanently attached to the member 15 by parallel lines of staples 26 near the margin of the seat 12, to prevent air contamination due to frayed edges.

The rigid panel member 15 near its opposite sides is provided with a pair of breathing openings 27 extending completely therethrough. Similarly, the bottom cover section 24 has a pair of breathing openings 28 formed therethrough. The breathing openings 27 and 28 may be in registering relationship on opposite sides of the element 17 or may be out of registration and staggered, as illustrated. The non-registering arrangement of the openings 27 and 28 possesses the advantage that the sheet filter element 17 cannot readily be punctured or damaged if an object is inserted in the opening 28, because the element 17 is backed up or reinforced by the hard member 15. When the openings 27 and 28 are in registration, it would be possible to rupture the element 17 were an object inserted through an opening 28.

However, either arrangement of the breathing openings 27 and 28 is operationally satisfactory, and in both cases air can enter the seat structure and be expelled therefrom only by passing through the openings 27 and 28 and also through the sheet filter element 17 disposed therebetween. In the case of registering breathing openings, not shown, the air passage is direct or axial with respect to the openings 27 and 28, whereas in the illustrated arrangement where the breathing openings are non-registering, the inflowing or outflowing air passes through one breathing opening and then along and through the filter element 17 to the other breathing opening on a zigzag path. It should now be clear that no air can enter or exit the seat structure on any other pathway due to the sealed arrangement of the air-impermeable cover sections 19 and 24 and the sealed relationship of the element 17 with panel member 15 and top cover section 19.

In the embodiment shown in FIG. 1, the seat 12 is attached by screws 29 to a flange 30 of the chair pedestal 11. These screws penetrate the member 15 and are dipped in adhesive sealant before installation. The lower cover section 24 can be apertured at 31, FIG. 2, adjacent to the screws 29.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In upholstered furniture for industrial clean rooms, a body support portion comprising a substantially rigid panel member, a yielding cushion on and substantially covering one face of said panel member, a filtering element adjacent to the other face of said panel member and being formed of thin hydrophylic sheet material capable of preventing the passage therethrough of particles substantially as small as 0.2 microns, an air impermeable sheet material cover for said body support portion surrounding and enclosing said panel member and cushion and being in hermetically sealed relationship with the panel member and the filtering element, the panel member and said cover being provided with opening means whereby air can enter and leave the body support portion while passing through said filtering element, said filtering element comprising a filtering sheet which substantially covers said other face of the panel member and is hermetically sealed to the panel member around the margins of the panel member and filtering sheet by a continuous layer of air impermeable sealant, and said opening means comprising air passage openings formed through the panel member on one side of the filtering sheet and air passage openings formed through said cover on the other side of the filtering sheet.

2. In upholstered furniture for industrial clean rooms as defined in claim 1, and the openings of the panel member and cover being in offset non-registering relationship.

3. In upholstered furniture for industrial clean rooms as defined in claim 1, and said air impermeable sheet material cover comprising a plastics material cover.

4. In upholstered furniture for industrial clean rooms as defined in claim 3, and said cover comprising a first cover section which spans said cushion and a marginal edge portion of the panel member and extends somewhat beneath the panel member adjacent to its marginal edge, and a second cover section substantially spanning the face of said panel member away from said cushion and having a folded marginal edge portion of double thickness which overlaps the first cover section where the latter extends beneath said panel member.

* * * * *